US008028449B2

(12) United States Patent
Zarelius

(10) Patent No.: US 8,028,449 B2
(45) **Date of Patent: *Oct. 4, 2011**

(54) COLLAPSIBLE DISPLAY-ARRANGEMENT

(75) Inventor: Christer Zarelius, Stockholm (SE)

(73) Assignee: Expand International AB, Johanneshov (SE)

( * ) Notice: Subject to any disclaimer, the term of this patent is extended or adjusted under 35 U.S.C. 154(b) by 1723 days.

This patent is subject to a terminal disclaimer.

(21) Appl. No.: 11/091,574

(22) Filed: Mar. 28, 2005

(65) Prior Publication Data

US 2005/0166430 A1 Aug. 4, 2005

Related U.S. Application Data

(63) Continuation of application No. 10/130,011, filed on Sep. 23, 2002, now Pat. No. 7,237,350.

(51) Int. Cl.
*G09F 15/00* (2006.01)

(52) U.S. Cl. ..... 40/610; 40/600; 40/605

(58) Field of Classification Search ..... 40/600, 40/610, 624, 729, 730, 594, 514, 517; 248/206.5; 160/24, 120, 135, 180, 263, 349.1, 368.1
See application file for complete search history.

(56) References Cited

U.S. PATENT DOCUMENTS

| | | | | |
|---|---|---|---|---|
| 1,013,856 | A * | 1/1912 | Armett | 434/172 |
| 5,666,751 | A * | 9/1997 | Garfinkle | 40/605 |
| 5,778,580 | A * | 7/1998 | Zarelius | 40/610 |
| 5,839,705 | A * | 11/1998 | LaMotte | 248/165 |
| 6,012,688 | A * | 1/2000 | LaMotte | 248/165 |
| 6,115,951 | A * | 9/2000 | Jing et al. | 40/610 |

FOREIGN PATENT DOCUMENTS

| | | |
|---|---|---|
| EP | 0 053 933 | 6/1982 |
| FR | 2 754 929 | 4/1998 |
| FR | 2 759 880 | 8/1998 |
| WO | WO-95/10104 | 4/1995 |
| WO | WO-00/08270 | 2/2000 |

* cited by examiner

*Primary Examiner* — Cassandra Davis
(74) *Attorney, Agent, or Firm* — Drinker Biddle & Reath LLP

(57) ABSTRACT

A collapsible display arrangement has a base unit for placing against and resting the collapsible display arrangement upon a support surface with a sheet formed from a rollable material. The sheet is rolled or unrolled and has an image. The collapsible display arrangement has a first rod as a support for cooperating with the base unit and for retaining the sheet in an exposed state with the sheet in the exposed state having an upper edge section, a first lateral edge section, and a second lateral edge section. The upper edge section is supported by a second rod provided with end related permanent magnets. Each magnet is oriented and has a magnetization direction and each has an attractive force that will operate between the permanent magnet and an adjacent second oriented permanent magnet. The second permanent magnet is connected to an adjacent second display arrangement, and each of permanent magnet has a magnetization direction causing an attractive force to the second oriented permanent magnet. The first lateral end section of the sheet is oriented adjacent to a second lateral edge section relative to a second display arrangement.

83 Claims, 5 Drawing Sheets

Fig. 15
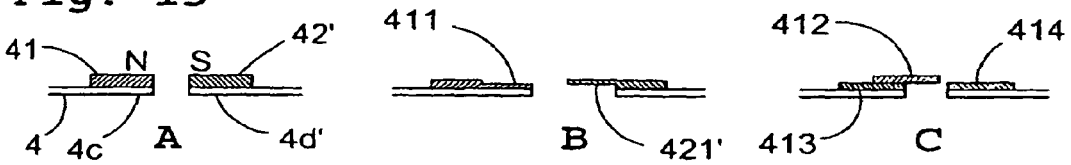
Fig. 16
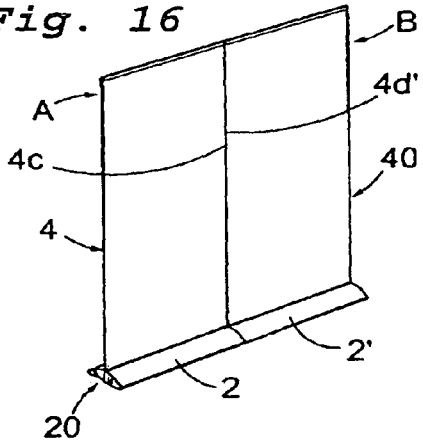
Fig. 17
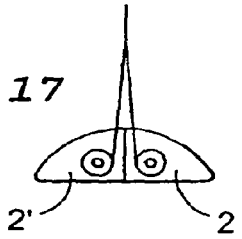
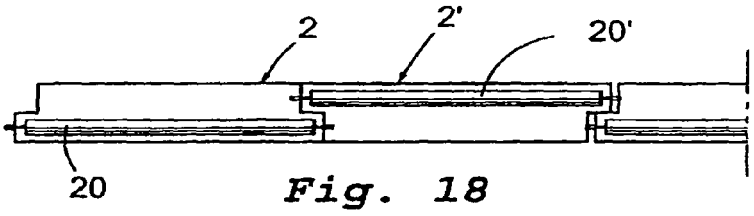
Fig. 18

COLLAPSIBLE DISPLAY-ARRANGEMENT

CROSS REFERENCE TO RELATED PATENT APPLICATIONS

This application is a continuation of, and claims priority to U.S. patent application Ser. No. 10/130,011 filed on Sep. 23, 2002, now U.S. Pat. No. 7,237,350, International Patent Application No.: PCT/SE00/02196 and Swedish Patent Application No.: 9904089-1 filed on Nov. 12, 1999.

TECHNICAL FIELD

The present invention relates generally to a collapsible display-arrangement and more particularly to a display arrangement having a base unit that can be placed, attached and/or rest against a support surface, a sheet, banner, panel, screen or the like that can be rolled up or unrolled and on which a picture and/or text appears, and also a support for supporting and retaining the sheet/banner/panel/screen.

In display arrangements of the type to which the present invention relates, it is already known to arrange a rod or the like at the upper edge of the sheet, said rod being designed to be able to firmly, but in easily removable manner, co-operate with an upper end part of said support.

The term "sheet" used hereafter refers primarily to a surface showing a picture and/or text applied on a cloth, a sheet of paper or other equivalent backing, the material of the sheet being so flexible and bendable that it can be rolled on a roller-blind rod or the like (with a diameter of 20 mm or more) and can be unrolled without the rolling having caused troublesome deformation when the sheet is unrolled. In the present patent application, the term "sheet" shall be interpreted as meaning all types of devices of this kind, including devices otherwise termed banners, panels, screens etc.

BACKGROUND ART

Display arrangements of the type described above are already known in a number of different embodiments, one example of such a display arrangement being shown in more detail and described with reference to FIGS. 1-4 of the present application.

Such a display arrangement has a base unit within which a sheet showing a picture or text that can be rolled up and unrolled, is rolled up like a roller-blind by means of a reeling device and wherein the sheet can be unrolled from the base unit and wherein a rod being arranged at the upper edge of the sheet and being attachable to the upper part of the support against the force of the reeling device in the base unit, the sheet being kept taut by its own weight and the spring force in the reeling device.

The display arrangement described above is marketed by Expand International AB, Nacka, Sweden, under the trade name "Quick Screen".

Observing now the significant properties of the present invention, it shall also be mentioned that it is already known to apply relatively thick magnetic strips to side-oriented edge parts of one or more sheets so that sheets placed adjacent each other may co-operate edge to edge without, or substantially without, obvious joins between the sheets.

DESCRIPTION OF THE PRESENT INVENTION

Technical Problem

Observing the circumstance that the technical deliberations one skilled in the art must perform in order to be able to offer a solution to one or more of the technical problems posed, there is initially an insight into the measures and/or the sequence of measures to be taken, and also a choice of the mean(s) necessary, and consequently the following technical problems are no doubt relevant when developing the present invention.

Considering the state of the art as described above it is undoubtedly a technical problem in a collapsible display arrangement of the type described in the introduction, to be able to create such conditions that a display arrangement and/or a plurality of adjacently placed display arrangements can be used to easily expose a picture and/or text and easily allow storage of the display arrangement in an assembled state.

A technical problem is also entailed in being able to create such conditions that, using a number of adjacently placed display arrangements, a picture or text extending across several display arrangements can be exposed without visible joins between adjacent display arrangements or, at least to be able to offer only negligibly discernible joins between them.

A technical problem is also entailed in being able to create such conditions that, particularly in display arrangements having a height that exceeds the stretch of a person and preferably considerably (0.2-1.0 m) exceeds the stretch of a person, the orientation of upper surface parts for the sheets, belonging to adjacently placed display arrangements, can be coordinated by means of magnetic attraction between permanent magnets related to surface parts or rods, for instance to upper surface parts.

It is a technical problem to be able to perceive the significance of allowing upper surface parts of a sheet to be provided with a reinforcing rod or the like, the end parts of which shall co-operate with permanent magnets, particular those manufactured with a high magnetic attractive force.

A technical problem is also entailed in being able to perceive the significance of and advantages associated with being able to simultaneously offer not only a horizontally directed magnetic co-operation and retention between the end parts of two upper rods or the like, belonging to one each of adjacently situated display arrangements, but also to create conditions for allowing opposing edge parts in the form of side-related edge parts of the sheet to be provided with individual permanently magnetised magnetic strips or the like in order to offer reinforcement of the co-operation of the sheets and offer a distinct vertical co-operation.

A technical problem is then entailed in being able to perceive the significance of and the advantages associated with allowing at least one end part of an upper rod be in distinct co-operation with an end part of a second rod, and where opposed end parts are adapted for being provided with at least one permanent magnet, and that the magnetisation direction or directions is/are so chosen that an attractive force will operate between said opposing end parts, such as a first permanent magnet pertaining to a first display arrangement and a second permanent magnet or the like pertaining to an adjacent display arrangement.

A technical problem is also entailed in being able to perceive the significance of and the advantages associated with allowing said rod to be assigned a longitudinally oriented cavity or a channel extending between end parts facing away from each other, in which one or more permanent magnets may be firmly related.

A technical problem is also entailed in being able to perceive the significance of being able to select a suitable shape for the purpose, and attractive force for the permanent magnet (s) or the like used, in order to produce one or more magnetic fields that are coordinated to attract appropriate rods or the like to each other and retain them in a fixed position in relation to each other, such as a straight extension or line, with a suitably high resistance to bending to permit the rods or the like to be withdrawn from their fixed position in relation to each other.

A technical problem is also entailed in being able to perceive the significance of allowing the end part of one rod to be provided with one or more permanent magnets.

It must furthermore be considered a technical problem to be able to choose a plurality of permanent magnets for one end part of an upper rod and a plurality of complementary permanent magnets for opposing end parts of an adjacent upper rod.

A technical problem is also entailed in being able to perceive the significance of allowing a rod or the like arranged at the lower edge of the sheet be provided, at least at one end part, with a permanent magnet designed for attractive co-operation with a complementary permanent magnet pertaining to a lower rod or the like of an adjacent display arrangement.

A technical problem is also entailed in being able to perceive the significance of allowing the lower rod also to be provided with one or more permanent magnets or the like pertaining to outwardly facing end parts of said lower rod.

A technical problem is also entailed in being able to perceive the significance of and the advantages associated with allowing at least one rod, e.g. a rod pertaining to the upper edge of the sheet, to be provided with a longitudinal edge-related reinforcement to which the upper edge part of the sheet can be attached.

A technical problem is also entailed in being able to perceive the significance of and the advantages associated with allowing at least one edge part, a side-related edge part, of the sheet be provided with a permanently magnetised thin magnetic strip or the like, said magnetic strip being assigned a magnetisation direction and/or selected magnetisation directions so directed and adjusted that an attractive force will operate between said magnetic strip and a complementary magnetic strip or the like attached to an oppositely directed side-related edge part for a sheet pertaining to an adjacent display arrangement.

A technical problem is also entailed in being able to perceive the significance of allowing said magnetic strips to be so oriented among themselves, along side-related edge parts, that a side-oriented edge part of one sheet will abut or be placed a short distance from a side-oriented edge part of a second, adjacent sheet.

A technical problem is also entailed in being able to perceive the significance of and the advantages associated with selecting a magnetic strip that is assigned a thickness of 0.4-1.5 mm, e.g. 0.4-0.6 mm.

It should be deemed a technical problem, using simple means, to create such conditions that magnetic strips applied can co-operate with an upper rod reinforcement in such a manner as to avoid fractural impressions in the sheet.

It is also a technical problem to be able to perceive the significance or allowing the magnetic strip or the like to extend past a removed end part for the reinforcement.

A technical problem is also entailed in being able to perceive the significance of allowing a magnetic strip or the like pertaining to a sheet, assigned to a side-related edge part, to extend a certain distance over the magnetic strip pertaining to an adjacent sheet.

A technical problem is also entailed in being able to perceive the significance of and the advantages associated with allowing said sheet to be provided with a magnetic strip for each side-related edge part and attaching a rod or the like for each end-related edge part so that the sheet constitutes a separate unit that can be rolled up or unrolled.

A technical problem is also entailed in being able to perceive the significance of allowing the lower edge of such a sheet to be provided with a rod or the like and for this rod to be designed for easy attachment to and removal from the base unit and/or support.

A technical problem is also entailed in being able to perceive the significance of and the advantages associated with allowing said co-operation between a rod pertaining to the upper and/or lower edge of the sheet or the like and said support or base unit to be resilient or elastic.

A technical problem is also entailed in being able, using simple means, to create such external forms for utilised base units, with enclosed reeling arrangement for the sheet, that a first sheet for a first display arrangement can be brought into edge co-operation with the second sheet of a second display arrangement.

A technical problem is also entailed in being able to perceive the significance of and the advantages associated with allowing magnetic strips having transversely oriented magnetisation or longitudinally oriented magnetisation, and making use of a thin steel strip having a function equivalent to that of a magnetic strip, create a sheet with good and satisfactory rollability and with good and satisfactory edge-related vertical co-operation.

It should furthermore be deemed a technical problem to be able to perceive the co-ordination required between co-operating magnetic strips or the co-operation required between a magnetic strip and an associated steel strip in order, despite these edge-reinforcing measures, still to be able to offer a sheet that can be easily rolled up and unrolled and has a sufficiently good magnetic co-operating with an adjacent sheet that is also provided with edge-reinforcing means such as magnetic strips or steel strips.

Solution

The present invention is based on a known collapsible and/or rollable display arrangement having a base unit for placing against a support surface, a sheet that can be rolled up or unrolled and on which a picture and/or text appears, and also a support for retaining the sheet in the base unit or the like, a rod or the like being arranged at one edge of the sheet for co-operation with said support via retaining means.

In order to solve one or more of the technical problems listed above, the present invention states that at least one end part of said rod or the like shall be designed to be able to be provided with and retain a permanent magnet, and that the magnetisation direction or directions of the magnet is/are so chosen that an attractive force will be able to operate between said permanent magnet and a permanent magnet or the like pertaining to an adjacent display arrangement.

In accordance with proposed embodiments, falling within the scope of the present invention, said rod shall be assigned a shape to which said permanent magnet can be firmly related.

It is also stated that the permanent magnet may be assigned cylindrical shape, with preferably circular cross section, or be assigned a more irregular shape such as a shape with square or rectangular cross section.

In accordance with the invention said rod or the like may be provided with one or more permanent magnets or the like pertaining to outwardly facing end parts.

Also in accordance with the invention the lower edge of the sheet or the like may be provided with a permanent magnet, at least at one of its end parts.

Said lower rod or the like shall preferably be provided with one or more permanent magnets belonging to outwardly facing end parts of the rod.

Also in accordance with the invention the rod, particularly the upper rod, shall be provided with reinforcement in its longitudinal direction, to which the upper edge of the sheet can be attached.

It is particularly stated that at least one edge part, a side-related edge part, of the sheet shall be provided with a thin permanently magnetised magnetic strip.

Said magnetic strip shall in that case be assigned a magnetisation direction and/or magnetisation directions so chosen that an attractive force will operate between said magnetic strip and a magnetic strip or the like pertaining to a side-related edge part of an adjacent display arrangement.

Said magnetic strips or the like are so oriented among themselves that a side-oriented edge part of one sheet will abut or be placed a short distance from a side-oriented edge part of an adjacent sheet.

Particularly in accordance with the invention the magnetic strip shall be thin, but shall still be able to offer a suitably chosen magnetic force for the application, and may thus in practice be assigned a thickness of 0.4-1.5 mm, e.g. 0.4-0.6 mm.

Also in accordance with the invention, a magnetic strip pertaining to one sheet may be designed to extend over the magnetic strip or the like pertaining to an adjacent sheet.

Particularly in accordance with the invention said sheet shall be provided with a magnetic strip or the like for each side-related edge part and a rod for each end-related edge part and thus constitutes a separate unit that can be rolled up or unrolled.

The lower edge of the sheet may in that case be provided with a rod that is attachable in the base part.

It is also stated that said co-operation between a rod pertaining to the upper and/or lower edge of the sheet and said support or base unit shall be resilient or elastic.

The base unit can also be assigned a shape enabling two base units, with reeling devices for the sheets, to be placed close together and with the side-related edge parts of the sheet in close proximity.

Various measures are also described for coordinating magnetic strips and steel strips for the edge parts of the sheet.

Advantages

The advantages that can primarily be considered characterizing for a collapsible display arrangement in accordance with the present invention are that conditions have been created for manufacturing a display arrangement in which conditions have been created for obtaining a sheet, mounted in a first display arrangement, to be able to co-operate edge-to-edge with an adjacent sheet pertaining to an adjacent second display arrangement.

Conditions have also been created for being able, in a simple manner, to get a rod or the like arranged at the upper edge of the sheet and pertaining to a first display arrangement, by means of magnetic attractive force, to be able to align co-operation with a rod or the like arranged at the upper edge of a sheet pertaining to a second display arrangement, in order to considerably facilitate orientation of display arrangements placed adjacently, even when said upper rods or the like are situated outside (above) the reach of a person when he/she is standing on a surface for the base unit.

The use of magnetic strips and/or steel strips for side-related and opposing edge parts of adjacent sheets offers the possibility of exposing a picture that extends over a plurality of display arrangements without visible edge lines.

The primary characteristics of a collapsible display arrangement in accordance with the present invention are defined in the characterizing part of the appended claim 1.

BRIEF DESCRIPTION OF THE DRAWINGS

A display arrangement known per se, and a number of currently proposed embodiments illustrating the significant features of the present invention will now be described in more detail by way of example, with reference to the accompanying drawings, in which FIG. 15 shows under sections A, B and C an end view of various embodiments of used sections applicable to suitable magnetic strips, FIG. 16 shows in perspective two display arrangements coordinated with each other, each sheet being rollable on a reeling device placed in the base unit, FIG. 17 shows a vertical cross section of the lower parts of two display arrangements, with their reeling devices, FIG. 18 shows a horizontal longitudinal section of the base parts for three display arrangements, each with its own reeling device.

DESCRIPTION OF PREVIOUSLY KNOWN EMBODIMENT

Figure 1:
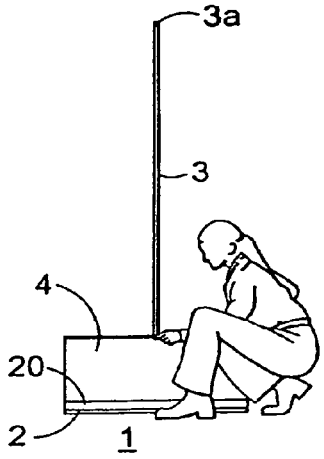
Fig. 1 (Prior Art)
FIGS. 1-4 show a previously known collapsible display arrangement of the prior art.
Figure 2:
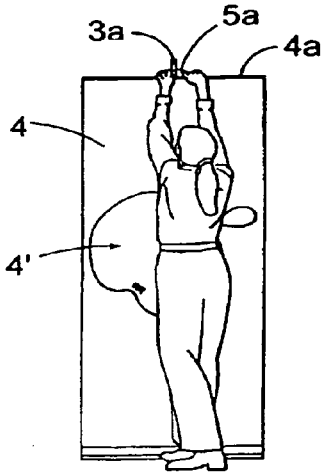
Fig. 2 (Prior Art)

FIGS. 1-4 show a selected sequence in the construction of a collapsible display arrangement in which a base unit 2, placeable against a surface 1, and a support 3 attached to the base unit 2 co-operate with each other.

A sheet 4 with, on one side, a picture and/or a text 4', which can be rolled up and unrolled by means of a roller-blind device 20 inside the base unit 2, is unrolled along the support 3 and attached in the upper part 3*a* of the support 3 by means 5*a* in its upper edge part 4*a*.

Figure 3:
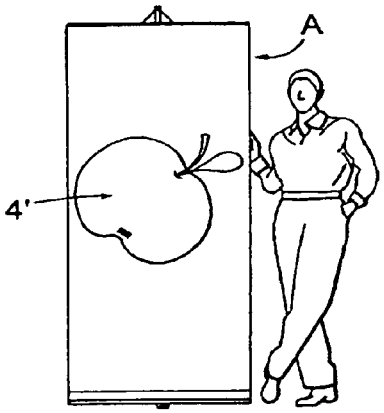
Fig. 3 (Prior Art)

FIG. 3 shows how a first display arrangement A is mounted in order to expose picture and/or text 4'.

Figure 4:
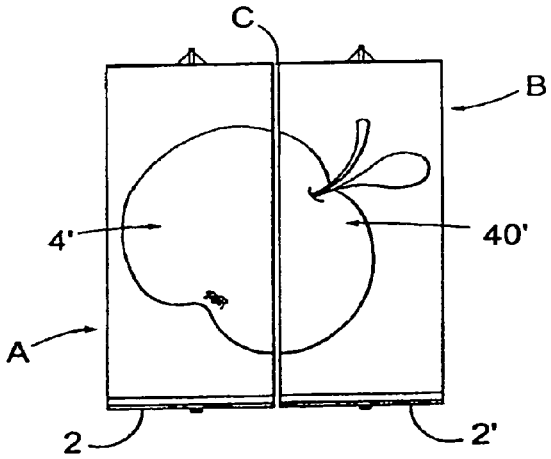
Fig. 4 (Prior Art)

FIG. 4 illustrates how a first display arrangement A is placed close to a second display arrangement B, and where according to the known method a space—C—must be accepted between the display arrangements A and B, and thus it must also be accepted that a picture 4' and 40', extending across both display arrangements A and B, is divided into two clearly separated parts by the obvious gap.

DESCRIPTION OF NOW PROPOSED EMBODIMENTS

Figure 5:
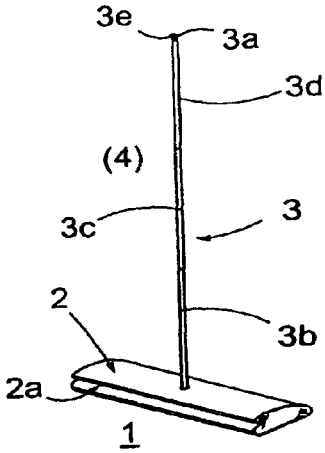
FIG. 5 shows in perspective a base unit resting against a surface, with a support extending upwardly therefrom.

FIG. 5 thus shows a collapsible display arrangement making use of a base unit 2 placeable on a surface 1, and a sheet 4 (not shown in FIG. 5), as well as a support 3 suitable for reinforcing and retaining the sheet 4.

The support 3 shown here consists of a chosen number of co-operating parts, such as three (3), 3*b*, 3*c*, 3*d*, said parts being foldable in a manner known per se, a resilient cord extending between the parts 3*b*, 3*c* and 3*d* so that the parts can be pulled apart and folded to parallel orientation with each other.

The length of each of the parts 3*b*, 3*c* and 3*d* is suited to the length of the base unit 2.

Of significance to the present invention is that the uppermost part 3*a* is provided with an attachment device 3*e* for co-operation with the sheet 4 and a means 5*a* in its upper edge part 4*a*.

Figure 6:
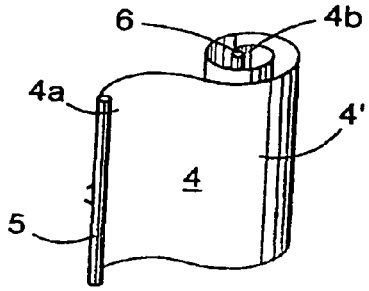
FIG. 6 shows in perspective a sheet on which appears a picture and/or text, which can be rolled up and unrolled.

FIG. 6 shows in perspective a partially rolled sheet 4. The sheet 4 consists of a separate unit having a surface 4' on which a picture and/or text appears. The sheet can be rolled up and unrolled, the picture and text surface 4' being applied on and spread over a single surface 4'.

Figure 9:
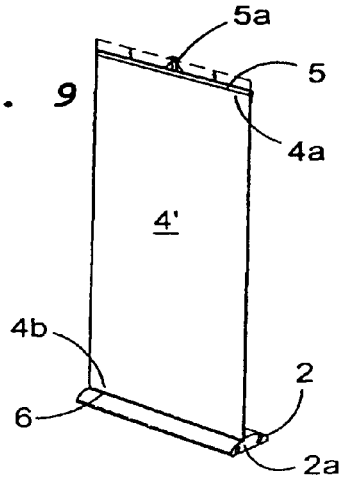
FIG. 9 shows in perspective the sheet placed between the base unit and the upper part of the support and resiliently retained thereby.

In accordance with FIG. 9 the upper edge part 4*a* of the sheet 4 co-operates with a rod 5 or the like, and the lower edge part 4*b* co-operates with a rod 6 or the like.

The rods 5 and 6 preferably have the same cross-sectional profile and are made of aluminium or alloys thereof.

Figure 7:
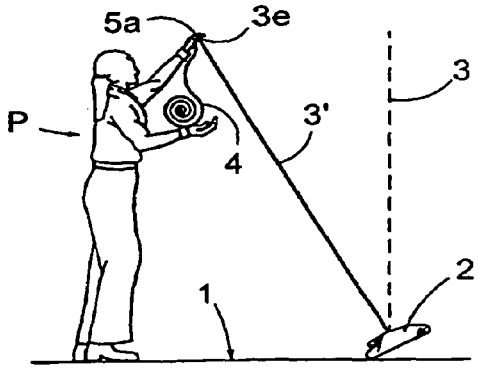
FIG. 7 shows how one end part, an upper end part, can be attached to the upper part of the support, by inclining the base unit and the support.

FIG. 7 is intended to illustrated schematically that the support 3 can preferably be tilted to an inclined position 3', and the base part 2 can also be correspondingly tilted in order to secure an attachment means 5*a* related to the rod 5 to the attachment device 3*e*, and to allow a person P to hold the rolled sheet 4 in his/her arms.

Figure 8:
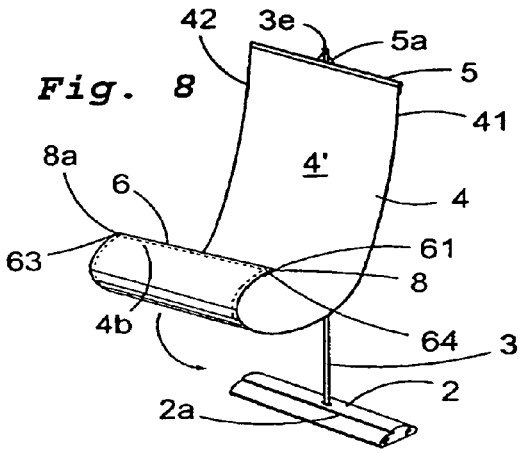
FIG. 8 shows a sequence in which a sheet is attached to the upper part of the support and is caused by its own weight to fall down along the support, towards the base unit.

The support 3' is then moved to the position shown in FIG. 5, also illustrated in FIG. 8, whereupon the sheet 4 can drop down, due to its own weight, along the support 3 and towards the base unit 2, so that the lower edge part 4*b* of the sheet 4 and the rod 6 can be attached in the manner shown in FIG. 9, e.g. in a groove 2*a* oriented in the base unit.

Figure 10:
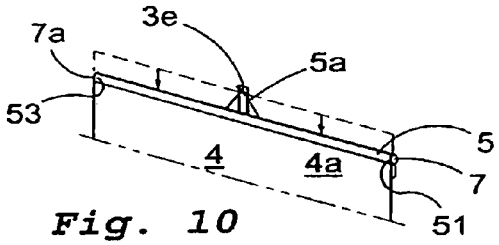
FIG. 10 shows an example of a proposed resilient attachment between the upper part of the sheet and the upper part of the support.

FIG. 10 illustrates how the upper edge part 4*a* of the sheet 4, with the rod 5 and attachment means 5*a*, co-operates with the attachment device 3*e* and that the means 5*a* or, alternatively, the device 3*e* is resilient, enabling the sheet 4 to be stretched up by means of a tensile force directed from the base unit 2.

There is nothing to prevent the lower edge part of the sheet from co-operating with the same or other flexible means.

Figure 11:
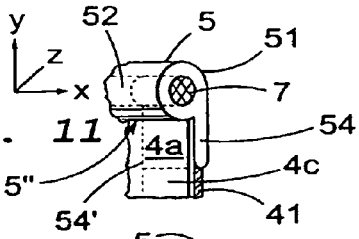
FIG. 11 shows on an enlarged scale one end part of a rod arranged for the upper edge part of the sheet, and a first embodiment of a permanent magnet placed therein.

FIG. 11 illustrates that at least one end part 51 of said rod 5 is designed to be provided with a permanent magnet 7.

The magnetisation direction or directions(s) are chosen here so that an attractive force will operate between said permanent magnet 7 and a second permanent magnet 7*a*' pertaining to a second, adjacent display arrangement B.

The rod 5 is assigned a surface against which the permanent magnet 7 can be attached in a manner known per se and using means known per se.

Here it is illustrated that the rod 5 shall be provided with a longitudinally oriented cavity 52, in which said permanent magnet 7 is permanently arranged.

The permanent magnets used may have different shapes and different cross sections and FIG. 11 illustrates that the permanent magnet 7 is assigned cylindrical shape, having circular cross section.

Figure 12:
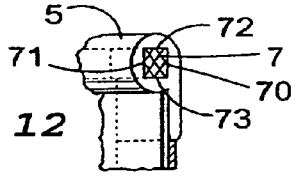
FIG. 12 shows in perspective an alternative embodiment to that shown in FIG. 11, of the permanent magnet used.

FIG. 12 illustrates that a permanent magnet 7 may be assigned a more irregular shape, more particularly a square or rectangular cross-section.

It is obvious that other embodiments fall within the scope of the invention with regard to length and cross section.

The embodiments of the permanent magnets 7 shown by way of example in FIGS. 11 and 12 are intended to illustrate that, besides the usual attractive force with the same flexural resistance in all directions (x-, y- and z-directions) between two permanent magnets or a permanent magnet and an iron part such as a part consisting of magnetisable steel that results from a circular-cylindrical permanent magnet in accordance with FIG. 11, the flexural resistance shall be adjustable differently in different directions by choosing different cross-sectional shapes for the permanent magnet or the steel part.

Referring to FIG. 12, it can be imagined that the edges 70 and 71 are chosen with greater attracting magnetic force than the edges 72 and 73. The flexural resistance of the edges 72 and 73 is reinforced by making use of the influence of edge-related magnetic strips so that a considerably higher flexural resistance appears in the x-/y-plane than in the x-/z-plane. A measure for increasing the flexural resistance in the x-/z-plane may therefore be desirable in certain applications.

This can be achieved with one or more permanently magnetising magnets.

It is specifically emphasised that said rod 5 may advantageously be provided with one or more permanent magnets 7, 7*a* belonging to outwardly facing end parts 51, 53 of said rod.

Thus FIG. 10 indicates that a first permanent magnet 7 or a first set of permanent magnets is oriented to the right-hand part 51 of the rod 5, while a second permanent magnet 7*a* or a second set of permanent magnets of identical or very similar shape, but having complementary magnetisation for attractive forces, is assigned to the left-hand edge part or end part 53 of the rod 5.

FIG. 8 is also intended to illustrate that a rod 6 arranged at the lower edge part 4*b* of the sheet 4 may be provided, at least at one end part 61, with a permanent magnet 8.

Said rod 6 is also provided with one or more permanent magnets 8*a* at outwardly facing end parts 61, 63 of said rod 6.

What has been described above with reference to FIGS. 11 and 12 and the permanent magnets 7 and 7*a* can also be applied to the permanent magnets 8 and 8*a*. However, the demand for high flexural resistance in the x-/z-plane can normally be reduced for the lower permanent magnets.

Permanent magnets used here shall preferably be "super-magnets" with high attractive force and little material.

FIG. 11 also shows that the rod 5 (and thus also the rod 6) may be provided with reinforcement 54, (64) in its longitudinal direction, to which the upper edge part 4*a* (or lower edge part 4*b*) of the sheet 4 can be attached.

The longitudinal reinforcement 54 preferably terminates at the reference 54', in which case the magnetic strip 41 or the like shall extend up towards the lower edge 5" of the rod 5.

The attachment may preferably be effected via one or more adhesive layers, one on the reinforcement 54 and possibly one on the edge part 4*a*.

A least one edge part of the sheet 4, a side-related edge part designated 4*c*, is provided with a permanently magnetised magnetic strip 41.

An outwardly facing edge part of the sheet 4, a side-related edge part designated 4*d*, is provided with a permanently magnetised magnetic strip 42.

The permanently magnetised magnetic strips 41 and 42 are placed on the rear of the sheet 4 so as not to encroach on the picture surface 4'.

Figure 13:
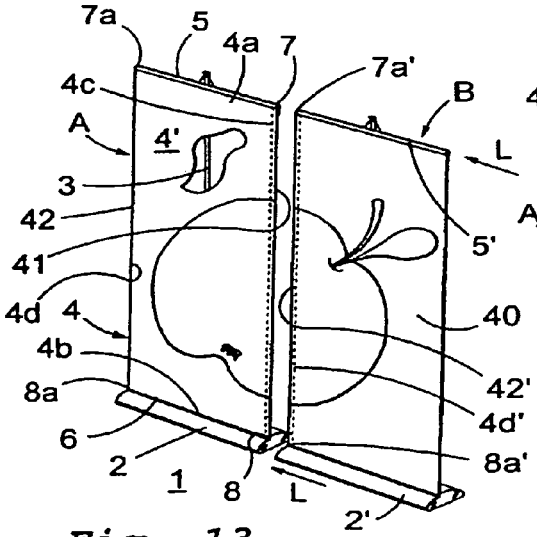
FIG. 13 shows how two display arrangements with mounted sheets are aligned with and oriented close to each other for mutual co-operation.
Figure 14:
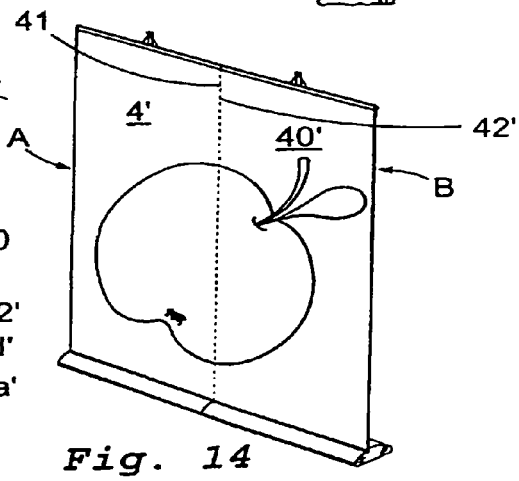
FIG. 14 shows that said two display arrangements according to FIG. 13 have been combined to a position in which they co-operate with each other and that the sheets pertaining to the display arrangements are thus able to expose a common picture the size of which requires two display arrangements, without visible joins in the picture area between these display arrangements.
Figure 19:
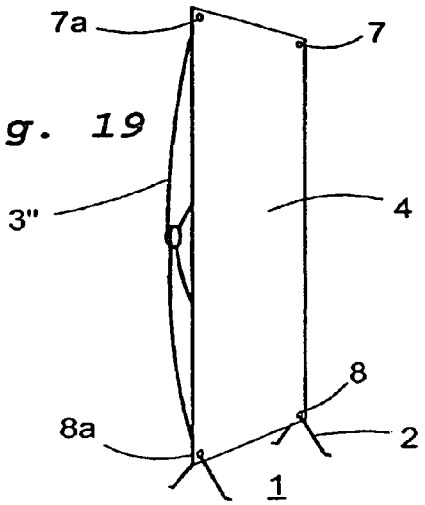
FIG. 19 shows a magnetic arrangement between two permanently magnetised strips.
Figure 20:
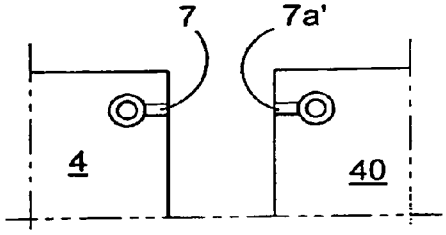
FIG. 20 shows a magnetic arrangement between a magnetised strip and a steel strip.

FIG. 13 illustrates how two display arrangements A and B shall be oriented before being brought together to form a display-arrangement assembly, oriented in accordance with FIG. 14, having a picture extending across two such display assemblies A and B with picture sections 4' and 40'.

FIG. 13 shows that the display arrangement B shall be moved towards the display arrangement A with the sheets 4 and 40, respectively.

As movement is initiated the permanent magnets 7, 7*a*' (and 8, 8*a*') attract each other and orient the rods 5, 5' in a line L. Continued movement is then possible along this line, possibly after adjustment of the base units 2, 2' in relation to the line L until the permanent magnets 7, 7*a*' (and 8, 8*a*) are in fully attracted position.

The magnetic strip 41 attracts the magnetic strip 42' to an adjusted exact position, determined by the position and polarity of the magnetic strips in selected sections.

Said magnetic strips 41; 42' are so oriented among themselves that an edge of a side-oriented edge part 4*c* of one sheet 4 will abut or be placed a short distance from an edge of a side-oriented edge part 4*d*' of an adjacent sheet 40, as can be seen more clearly in FIG. 14.

The magnetic strip 41, as well as the other magnetic strips, shall be thin and in practice they may be assigned a thickness of 0.5 mm.

It should be noted that an attracting co-operation between two magnetic strips may equally well be offered between a permanently magnetised strip and a steel strip or corresponding magnetisable strip. It is thus clear that a magnetic strip may very well be replaced with a steel strip which should in that case be 0.1-0.4 mm thick, in practice say about 0.2 mm thick, and with a width corresponding to the width of the magnetic strip or slightly narrower.

The choice of thickness is dependent, among other factors, on the stiffness of the magnetic strip upon bending, the stiffness of the sheet material upon bending, e.g. chosen radius of curvature, permissible deformation, chosen attractive force for one magnetic strip towards another magnetic strip and, naturally, if a magnetic strip is replaced with a thinner steel strip.

One magnetic strip 41 belonging to a sheet may also be designed to extend over a magnetic strip pertaining to an adjacent sheet.

As described above, said sheet 4 is provided with a magnetic strip 41, 42 (or steel strip) for each side-oriented edge part 4*c*, 4*d* and a rod 5, 6 for each end-related edge part 4*a* and 4*b*, and thus constitutes a separate unit that can be rolled up or unrolled.

There is nothing to prevent the lower edge part 4*b* of the sheet 4, being provided with a rod 6 so that this rod is attachable in the base part 2 and/or the support 3, and particularly in a groove 2*a* in the base unit 2 of the support 3.

There is nothing to prevent the lower edge part 4*b* of the sheet 4 being attachable to a device 20 for rolling up and unrolling the sheet, as shown in FIGS. 16, 17 and 18.

FIG. 15 illustrates, in the sections A, B and C, different cross sections for magnetic strips for allowing en edge part 4*c* with a magnetic strip 41 to co-operate with an edge part 4*d*' with a magnetic strip 42'.

FIG. 15 shows the equivalent position to that shown in FIG. 13.

The magnetic strips 41 and 42' are here identical in shape and consist of a transversally magnetised strip, with an adhesive surface, for contact against the sheet 4 and edge part 4*c*, and against the sheet 40 and edge part 4*d*. Edge surfaces facing each other are thus magnetised with opposite polarity and when these edge surfaces are brought into proximity they are attracted to each other.

The thinner the magnetic strip is the better will be the rolling ability of the sheet when rolling is chosen with the magnetic strips peripherally or edge oriented.

In section A the edge-related end surfaces of the magnetic strips are assigned different magnetisation or polarities and thus form right-hand or left-hand sides for co-operation with sides of an adjacent display arrangement placed opposite.

Section B illustrates a magnetic strip 41 shaped with a narrower edge 411 and a magnetic strip shaped with a recess 421'. For this embodiment it is advisable for the magnetisation to be in longitudinal direction so that the two magnetic strips can co-operate with each other with a distinct orientation of the edge parts for connection of adjacent display arrangements.

The narrower part and the recess have been assigned different and complementary magnetisations and thus form right-hand and left-hand sides, in the same way as in section A.

Section C illustrates a magnetic strip shaped so that an additional magnetic strip shape 412 consists of a magnetic strip that creates improved magnetic force.

Here, too, it is a question of transversal magnetisation of the magnetic strips 412 and 414, with a co-operation in accordance with FIG. 15B.

The part 413 represents an adhesive layer, a strip of foam plastic or other thin material (the thickness is exaggerated in the figure).

The magnetic co-operation between permanently magnetised strips or between a magnetic strip and a steel strip will be described in more detail with reference to FIGS. 21 and 22.

FIG. 16 shows in perspective a display arrangement in which the sheet 4 is rolled on a reeling device 20 inside the base unit 2.

To ensure that the display arrangements A and B and the sheets 4 and 40 are so close together that the edges 4*c* and 4*d*' are in contact with each other and retained by a magnetic force, hook-shaped end parts are required for the base units 2 and 2' so that the torsional axes can overlap each other by being laterally displaced.

It should be noted that this arrangement requires the picture surface to be formed on opposite surfaces, the front surface for one display arrangement and the rear surface for the other arrangement.

FIG. 21 shows an embodiment in which one edge part 4*d*' is provided with a magnetic strip 42' and has transversal magnetisation direction, designated N and S, respectively.

This magnetic strip can now co-operate distinctly with a magnetic strip 412'. A magnetic strip attached to an adjacent display arrangement can also co-operate with this magnetic strip 412' and this co-operation is in line with those that shall operate in accordance with the principles of the invention. The magnetic strip 412' may also consist of a separate unit.

FIG. 22 shows how a magnetic strip 42' can be assigned considerably less thickness than in FIG. 21, and shall co-operate with a steel strip 222.

This steel strip could be applied on the edge parts of the sheet and act with magnetic force on a magnetic strip 412' in accordance with FIG. 21.

With transversally oriented magnetisation and with reduced thickness it is to be expected that the distance between unipolar magnetisation lines will decrease. Known technology indicates that the ratio thickness/magnetisation width for a pole should be 1:2. However, in the case of extremely thin magnetic strips the ratio in accordance with the invention should be between 1:15 and 1:4, e.g. around 1:6.

The use of two steel strips for the edges of the sheet enables a smaller radius of curvature for rolling up. Such an embodiment indicates that adjacent sheets will have two edge-related magnetic strips, probably with somewhat greater radius of curvature. The thickness of the steel strip may be between 0.1 and 0.3 mm, e.g. 0.25 mm.

The width of a magnetisation line should be between 2 and 5 mm, preferably about 3 mm.

The invention is naturally not limited to the embodiment revealed above by way of example but may undergo modifications within the scope of the inventive concept illustrated in the appended claims.

The invention claimed is:

1. A collapsible display arrangement comprising:

a base unit;

a sheet; and a plurality of support parts being a support structure connected to said base unit and for retaining said sheet in an exposed-sheet state, said sheet in the exposed-sheet state having a plurality of edge parts, wherein at least one of said plurality of edge parts is supported by at least one rod, said at least one rod being provided with at least one magnet, wherein said at least one magnet is oriented and has a magnetization direction and has an attractive force that will operate between said at least one magnet and an adjacent second magnet connected to an adjacent second display arrangement, wherein said at least one magnet causes an attractive force being between said at least one magnet and said adjacent second magnet, wherein said sheet in the exposed-sheet state is oriented adjacent to a second side-oriented edge part of said second display arrangement, wherein said sheet has a magnetic strip for at least one of the plurality of edge parts of said sheet, and wherein said sheet is adapted to roll and unroll with said magnetic strip connected thereto.

2. A collapsible display arrangement comprising:

a first collapsible display arrangement and a second collapsible display arrangement, the first collapsible display arrangement comprising:

a base unit for placing against and resting the collapsible display arrangement upon a support surface;

a sheet being formed from a rollable material, said sheet being adapted to be rolled or unrolled, said sheet having an image that appears thereon; and a first rod as a support for cooperating with said base unit and for retaining said sheet in an exposed state, said sheet in said exposed state having an upper edge section, a first side-oriented edge section, and a second side-oriented edge section, wherein said upper edge section is supported by a second rod provided with an at least one permanent magnet, wherein said at least one permanent magnet is oriented and has a magnetization direction, wherein said at least one permanent magnet has an attractive force that will operate between said at least one permanent magnet and the second collapsible display arrangement when the second collapsible display is adjacent to the first collapsible display, the second display arrangement comprising at least one second oriented permanent magnet, wherein said at least one permanent magnet has a magnetization direction causing an attractive force to the at least one second oriented permanent magnet, whereby said first side-oriented edge section of said sheet is oriented adjacent to a side-oriented edge section related to the second display arrangement, wherein said sheet has a magnetic strip for said first side-oriented edge section of said sheet, and wherein said sheet is adapted to roll and unroll.

3. The display arrangement as claimed in claim 2, wherein said second rod has a shape to which said at least one permanent magnet is firmly related thereto.

4. The display arrangement as claimed in claim 2, wherein said at least one permanent magnet has a cylindrical shaped cross section.

5. The display arrangement as claimed in claim 2, wherein said at least one permanent magnet has an irregular shaped cross section.

6. The display arrangement as claimed in claim 2, wherein said at least one permanent magnet has a cross section, wherein said cross section has a shape that is selected from the group consisting of a square cross section, and a rectangular cross section.

7. The display arrangement as claimed in claim 2, wherein said second rod has said at least one permanent magnet at an outwardly facing end portion.

8. The display arrangement as claimed in claim 2, wherein said second rod has a reinforcement in a longitudinal direction, and wherein said upper edge section of said sheet is connected to said second rod.

9. The display arrangement as claimed in claim 8, wherein said reinforcement has a length shorter than said second rod.

10. The display arrangement as claimed in claim 2, wherein said first side-oriented edge section of said sheet has a first permanently magnetized magnetic strip, and wherein said first permanently magnetized magnetic strip and a second permanently magnetized magnetic strip of said second collapsible display arrangement are oriented relative to one another that said first side-oriented edge section of said sheet will abut and be placed a distance away from a side-oriented edge section of a second sheet of said second collapsible display arrangement.

11. The display arrangement as claimed in claim 10, wherein said first permanently magnetized magnetic strip and said second permanently magnetized magnetic strip are oriented relative to one another that said first side-oriented edge section of said sheet will abut and be placed a distance away from said side-oriented edge section of said second sheet of said second collapsible display arrangement.

12. The display arrangement as claimed in claim 11, wherein said first and said second permanently magnetized magnetic strips have a thickness in a range of about 0.4 to about 1.5 millimeters.

13. The display arrangement as claimed in claim 12, further comprising a longitudinal distance between magnetization of said first permanently magnetized magnetic strip and said second permanently magnetized magnetic strip, wherein said distance is about 2 millimeters to about 5 millimeters.

14. The display arrangement as claimed in claim 12, wherein said first permanently magnetized magnetic strip extends over said second permanently magnetized magnetic strip that is connected to said second sheet.

15. The display arrangement as claimed in claim 2, wherein said base unit has a recess at an end wall that is adapted to cooperate with a protrusion in an adjacent second base unit.

16. The display arrangement as claimed in claim 2, wherein each of said first and second side-oriented edge sections of said sheet has a longitudinally running side oriented edge part, said longitudinally running side oriented edge part having a magnetic strip magnetized in a transverse direction.

17. The display arrangement as claimed in claim 16, wherein said first side-oriented edge section faces away from said second side-oriented edge section, and wherein each of said first side-oriented edge section and said second side-oriented edge section has a substantially parallel magnetized magnetic strip.

18. The display arrangement as claimed in claim 2, wherein said sheet has a longitudinally running side oriented edge part with a magnetized magnetic strip, and wherein said magnetic strip is magnetized in a longitudinal direction.

19. The display arrangement as claimed in claim 2, wherein said first side-oriented edge section faces away from said second side-oriented edge section, wherein said first side-oriented edge section has a first steel strip and said second side-oriented edge section has a second parallel steel strip, and wherein said first steel strip and said second parallel steel strip cooperate with said magnetic strip.

20. The display arrangement as claimed in claim 19, wherein said second side-oriented edge section has a second magnetic strip, and wherein said second magnetic strip cooperates with said magnetic strip for replacing at least said second parallel steel strip.

21. The display arrangement as claimed in claim 20, wherein said second parallel steel strip has a thickness, and wherein said thickness is in a range of about 0.1 millimeters to about 0.4 millimeters.

22. A collapsible display arrangement comprising:

a first collapsible display arrangement and a second collapsible display arrangement, the first collapsible display arrangement comprising:

a base unit for placing against and resting said first collapsible display arrangement upon a support surface;

a sheet being formed from a rollable material, said sheet being adapted to be rolled or unrolled, said sheet having an image that appears thereon; and a first rod as a support for cooperating with said base unit and for retaining said sheet in an exposed state, said sheet in said exposed state having an upper edge part, a first side oriented edge part, and a second side oriented edge part, wherein said upper edge part is supported by a second rod provided with end related permanent magnets, wherein each of said end related permanent magnets is oriented and has a magnetization direction, wherein each of said end related permanent magnets has an attractive force that will operate between said end related permanent magnet and an adjacent second end related permanent magnet, the adjacent second end related permanent magnet being connected to said second display arrangement, wherein each of said end related permanent magnet has a magnetization direction causing an attractive force to the second end related permanent magnet, whereby said first side oriented edge part of said sheet is oriented adjacent to an edge part related to the second display arrangement, wherein said second rod has a reinforcement in a longitudinal direction, and wherein said upper edge part of said sheet is connected to said second rod.

23. The display arrangement as claimed in claim 22, wherein said second rod has a shape to which each at least one end related permanent magnet is firmly related thereto.

24. The display arrangement as claimed in claim 22, wherein at least one of said end related permanent magnets has a cylindrical shaped cross section.

25. The display arrangement as claimed in claim 22, wherein at least one of said end related permanent magnets has an irregular shaped cross section.

26. The display arrangement as claimed in claim 22, wherein at least one of said end related permanent magnets has a cross section, and wherein said cross section has a shape that is selected from the group consisting of a square cross section, and a rectangular cross section.

27. The display arrangement as claimed in claim 22, wherein said second rod has one of said end related permanent magnets at an outwardly facing end portion of said second rod.

28. The display arrangement as claimed in claim 22, wherein said second rod has a reinforcement in a longitudinal direction, and wherein said upper edge part of said sheet is connected to said second rod.

29. The display arrangement as claimed in claim 28, wherein said reinforcement has a length shorter than said second rod.

30. The display arrangement as claimed in claim 22, wherein said first side oriented edge part of said sheet has a first permanently magnetized magnetic strip, and wherein said first permanently magnetized magnetic strip and a second permanently magnetized magnetic strip are oriented relative to one another, and said first side edge part of said sheet will abut and be placed a distance away from an edge part of a second sheet of said second collapsible display arrangement.

31. The display arrangement as claimed in claim 30, wherein said first permanently magnetized magnetic strip and said second permanently magnetized magnetic strip are oriented relative to one another and said first side oriented edge part will abut and be placed a distance away from said edge part.

32. The display arrangement as claimed in claim 31, wherein said first permanently magnetized magnetic strip has a thickness in a range from about 0.4 millimeters to about 1.5 millimeters.

33. The display arrangement as claimed in claim 32, further comprising a longitudinal distance between magnetization of said first permanently magnetized magnetic strip and said second permanently magnetized magnetic strip, wherein said distance is in a range from about 2 millimeters to about 5 millimeters.

34. The display arrangement as claimed in claim 32, wherein said first permanently magnetized magnetic strip extends over said second permanently magnetized magnetic strip connected to said second sheet.

35. The display arrangement as claimed in claim 22, wherein said base unit has a recess at an end wall that is adapted to cooperate with a protrusion in an adjacent second base unit.

36. The display arrangement as claimed in claim 22, wherein said sheet has a longitudinally running side oriented edge part, said longitudinally running side oriented edge part having a magnetized magnetic strip magnetized in a transverse direction.

37. The display arrangement as claimed in claim 22, wherein said sheet has a longitudinally running side-oriented edge part with a magnetized magnetic strip, and wherein said magnetized magnetic strip is magnetized in a longitudinal direction.

38. The display arrangement as claimed in claim 22, wherein said first side oriented edge part faces away from said second side oriented edge part, and wherein each of said first side oriented edge part and said second side oriented edge part has a substantially parallel magnetized magnetic strip thereon.

39. The display arrangement as claimed in claim 22, wherein said first side oriented edge part includes a first steel strip and said second side oriented edge part includes a second steel strip, and wherein said first steel strip and said second steel strip cooperate with a magnetized magnetic strip at an edge thereof.

40. The display arrangement as claimed in claim 39, wherein said second steel strip has a thickness, and wherein said thickness is in a range from about 0.1 millimeters to about 0.4 millimeters.

41. The display arrangement as claimed in claim 22, wherein said first side oriented side oriented edge part has a first magnetized magnetic strip and said second side oriented edge part has a second magnetized magnetic strip, and wherein said second magnetized magnetic strip cooperates with said first magnetized magnetic strip.

42. The display arrangement as claimed in claim 22, wherein each of said first side oriented edge part and said second side oriented edge part has a magnetic strip, said first rod associated with a lower edge part of said sheet and said second rod associated with said upper edge part and wherein said sheet rolls and unrolls with each of said second rod and said first rod.

43. The display arrangement as claimed in claim 42, wherein said first rod is adapted for connecting to said base unit.

44. The display arrangement as claimed in claim 22, wherein said second rod is connected to said sheet and said first rod is adjacent said base unit, and said second rod and said first rod are resilient members.

45. A collapsible display arrangement comprising:

a first collapsible display arrangement and a second collapsible display arrangement, the first collapsible display arrangement comprising a base unit for placing against and resting the first collapsible display arrangement upon a support surface;

a sheet being formed from a rollable material, said sheet being adapted to be rolled or unrolled, said sheet having an image that appears thereon; and a first rod as a support for cooperating with said base unit, said first rod retaining said sheet in an exposed state, said sheet in said exposed state having an upper edge section, a first side oriented edge part, a second side oriented edge part, and a lower edge section, wherein said upper edge section is supported by a second rod provided with at least one permanent magnet, wherein said at least one permanent magnet is oriented and has a magnetization direction, wherein said at least one permanent magnet has an attractive force that will operate between said at least one permanent magnet and an adjacent second permanent magnet, said adjacent second permanent magnet being connected to said second collapsible display arrangement, and wherein said at least one permanent magnet has a magnetization direction causing an attractive force to the adjacent second permanent magnet, whereby said first side oriented edge part of said sheet is oriented adjacent to an edge part related to said second display arrangement, and wherein said lower edge section of said sheet is attachable to a base unit enclosing device for rolling and unrolling said sheet.

46. The display arrangement as claimed in claim 45, wherein said second rod has a shape to which said at least one permanent magnet is firmly related thereto.

47. A display arrangement as claimed in claim 45, wherein said at least one permanent magnet has a cylindrical shaped cross section.

48. The display arrangement as claimed in claim 45, wherein said at least one permanent magnet has an irregular shaped cross section.

49. The display arrangement as claimed in claim 45, wherein said at least one permanent magnet has a cross section, wherein said cross section has a shape that is selected from the group consisting of a square cross section, and a rectangular cross section.

50. The display arrangement as claimed in claim 45, wherein said second rod has said at least one permanent magnet at an outwardly facing end portion of said second rod.

51. The display arrangement as claimed in claim 45, wherein said second rod has a reinforcement in a longitudinal direction, and wherein said upper edge section of said sheet is connected to said second rod.

52. The display arrangement as claimed in claim 51, wherein said reinforcement has a length shorter than said second rod.

53. The display arrangement as claimed in claim 52, further comprising a permanently magnetized magnetic strip and a second permanently magnetized magnetic strip being oriented relative to one another that at least one of the first side oriented edge part and second side oriented edge part of said sheet will abut and be placed a distance away from an edge part of a second sheet of said second collapsible display arrangement.

54. The display arrangement as claimed in claim 45, wherein said sheet has a longitudinally running side oriented edge part, said longitudinally running side oriented edge section having a magnetized magnetic strip magnetized in a transverse direction.

55. The display arrangement as claimed in claim 45, wherein said sheet has a longitudinally running side oriented edge part with a magnetized magnetic strip, and wherein said magnetized magnetic strip is magnetized in a longitudinal direction.

56. The display arrangement as claimed in claim 45, wherein said first side oriented edge part faces away from said second side oriented edge part, and wherein each of said first side oriented edge part and said second side oriented lateral edge part has a substantially parallel magnetized magnetic strip.

57. The display arrangement as claimed in claim 45, wherein said first side oriented edge part faces away from said second side oriented edge part, wherein said first side oriented edge part has a first steel strip and said second side oriented edge part has a second parallel steel strip, and wherein said first steel strip and said second parallel steel strip cooperates with a magnetized magnetic strip.

58. The display arrangement as claimed in claim 57, wherein said first side oriented edge part has said magnetic strip and said second side oriented edge part has a second magnetized magnetic strip, and wherein said second magnetized magnetic strip cooperates with said magnetized magnetic strip for replacing said second parallel steel strip.

59. The display arrangement as claimed in claim 57, wherein said second parallel steel strip has a thickness, and wherein said thickness is in a range selected from 0.1 millimeters to about 0.4 millimeters.

60. The display arrangement as claimed in claim 45, further comprising a first and second permanently magnetized magnetic strips each having a thickness in a range of about 0.4 to about 1.5 millimeters, wherein a longitudinal distance between magnetization of said first permanently magnetized magnetic strip and said second permanently magnetized magnetic strip is in a range of about 2 millimeters to about 5 millimeters.

61. A collapsible display arrangement comprising:

a first collapsible display arrangement and a second collapsible display arrangement, the first collapsible display arrangement comprising:

a base unit for placing against and resting the first collapsible display arrangement upon a support surface;

a sheet being formed from a rollable material, said sheet being adapted to be rolled or unrolled, said sheet having an image that appears thereon; and a first rod as a support for cooperating with said base unit and for retaining said sheet in an exposed state, said sheet in said exposed state having an upper edge section, a first side oriented edge part, and a second side oriented edge part, wherein said upper edge section is supported by a second rod provided with at least one permanent magnet, wherein said at least one permanent magnet is oriented and has a magnetization direction, wherein said at least one permanent magnet has an attractive force that will operate between said at least one permanent magnet and an adjacent second at least one permanent magnet that is connected to said second display arrangement, wherein said at least one permanent magnet has a magnetization direction causing an attractive force to the adjacent second at least one permanent magnet, whereby said first side oriented edge part of said sheet is oriented adjacent to a side part of said second display arrangement, and wherein said sheet has a lower edge section being connected to the first rod.

62. The display arrangement as claimed in claim 61, wherein said second rod has a shape, said at least one permanent magnet being firmly related to said second rod.

63. The display arrangement as claimed in claim 61, wherein said at least one permanent magnet has a cylindrical shaped cross section.

64. The display arrangement as claimed in claim 61, wherein said at least one permanent magnet has an irregular shaped cross section.

65. The display arrangement as claimed in claim 61, wherein said at least one permanent magnet has a cross section, and wherein said cross section has a shape that is selected from the group consisting of a square cross section, and a rectangular cross section.

66. The display arrangement as claimed in claim 61, wherein said second rod has said at least one permanent magnet at an outwardly facing end portion of said second rod.

67. The display arrangement as claimed in claim 61, wherein said first rod has a magnet at an outwardly facing end of said first rod.

68. The display arrangement as claimed in claim 61, wherein said second rod has a reinforcement in a longitudinal direction, and wherein said upper edge section is connected to said second rod.

69. The display arrangement as claimed in claim 61, wherein said first side oriented edge part has a first permanently magnetized magnetic strip.

70. The display arrangement as claimed in claim 69, wherein said first permanently magnetized magnetic strip has a thickness in a range of about 0.4 to about 1.5 millimeters.

71. The display arrangement as claimed in claim 70, wherein said first permanently magnetized magnetic strip extends over a second permanently magnetized magnetic strip connected to a second sheet of said second collapsible display arrangement.

72. The display arrangement as claimed in claim 70, further comprising a longitudinal distance between magnetization of said first permanently magnetized magnetic strip and a second permanently magnetized magnetic strip, wherein said longitudinal distance is in a range of about 2 millimeters to about 5 millimeters.

73. The display arrangement as claimed in claim 69, wherein said first permanently magnetized magnetic strip is assigned a magnetization direction, and wherein said magnetization direction is such that an attractive force will operate between said first permanently magnetized magnetic strip and a second permanently magnetized magnetic strip pertaining to a second sheet of said second collapsible display arrangement.

74. The display arrangement as claimed in claim 73, wherein said first permanently magnetized magnetic strip and said second permanently magnetized magnetic strip are oriented relative to one another such that at least one of said first side oriented edge section and second side oriented edge, section of said sheet will abut and be placed a distance away from an edge section of said second sheet.

75. The display arrangement as claimed in claim 61, wherein said sheet has a magnetic strip for each of said first side oriented edge part and said second side oriented edge part of said sheet, and wherein said sheet is adapted to roll and unroll with each of said second rod and said first rod.

76. The display arrangement as claimed in claim 75, wherein said second rod and a third rod are resilient members.

77. The display arrangement as claimed in claim 75, wherein said lower edge section of said sheet and a third rod are adapted for connecting to said base unit.

78. The display arrangement as claimed in claim 61, wherein said sheet has a longitudinally running side oriented edge section, said longitudinally running side oriented edge section having a magnetic strip magnetized in a transverse direction.

79. The display arrangement as claimed in claim 61, wherein said sheet has a longitudinally running side oriented edge part with a magnetized magnetic strip, and wherein said magnetized magnetic strip is magnetized in a longitudinal direction.

80. The display arrangement as claimed in claim 61, wherein said first side oriented edge part faces away from said second side oriented edge part, and wherein each of said first side oriented edge part and said second side oriented edge part has a parallel steel strip for co-operating with a magnetized magnetic strip.

81. The display arrangement as claimed in claim 80, wherein said first side oriented edge part has said magnetized magnetic strip and said second side oriented edge part has a second magnetized magnetic strip, and wherein said second magnetized magnetic strip cooperates with said magnetized magnetic strip.

82. The display arrangement as claimed in claim 81, wherein said parallel steel strip has a thickness, and wherein said thickness is in a range of 0.1 millimeters to about 0.4 millimeters.

83. A collapsible display arrangement comprising:

a base unit for placing against and resting the collapsible display arrangement upon a support surface;

a sheet being formed from a rollable material, said sheet being adapted to be rolled or unrolled, said sheet having an image that appears thereon;

a first rod as a support for cooperating with said base unit and for retaining said sheet in an exposed state, said sheet in said exposed state having an upper edge section, a first lateral edge section and a second lateral edge section, wherein said upper edge section is supported by a second rod provided with end related permanent magnets, wherein each of said end related permanent magnets is oriented and has a magnetization direction, wherein each of said end related permanent magnets has an attractive force that will operate between one of said end related permanent magnets and a second display arrangement that has a second permanent magnet placed adjacent to said collapsible display arrangement, wherein said one of said end related permanent magnets has a magnetization direction causing an attractive force between said one of said end related permanent magnets and the second permanent magnet, whereby said first lateral edge section of said sheet is oriented adjacent to a lateral edge section of the second display arrangement, and wherein said sheet has a lower edge section being connected to said first rod.

* * * * *